US008322795B2

(12) United States Patent
Zimmerman et al.

(10) Patent No.: US 8,322,795 B2
(45) Date of Patent: Dec. 4, 2012

(54) MINER CUTTING BIT HOLDING APPARATUS

(75) Inventors: Joseph J. Zimmerman, Franklin, PA (US); Peter P. Chandler, Franklin, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 210 days.

(21) Appl. No.: 12/692,164

(22) Filed: Jan. 22, 2010

(65) Prior Publication Data

US 2011/0181098 A1 Jul. 28, 2011

(51) Int. Cl.
*E21C 35/18* (2006.01)

(52) U.S. Cl. ..... 299/79.1; 299/81.1

(58) Field of Classification Search ..... 299/79.1, 299/81.1, 81.3, 107, 39.8
See application file for complete search history.

(56) References Cited

U.S. PATENT DOCUMENTS

| | | | | | |
|---|---|---|---|---|---|
| 3,992,061 | A | * | 11/1976 | Rollins | 299/102 |
| 4,343,516 | A | * | 8/1982 | Aden | 299/106 |
| 4,542,943 | A | * | 9/1985 | Montgomery, Jr. | 299/102 |
| 4,733,914 | A | * | 3/1988 | Kogelmann | 299/81.2 |
| 4,944,560 | A | | 7/1990 | Osterwise | |
| 6,099,081 | A | * | 8/2000 | Warren et al. | 299/104 |
| 6,315,365 | B1 | * | 11/2001 | Gerer et al. | 299/78 |
| 6,764,141 | B2 | * | 7/2004 | O'Neill | 299/81.3 |

FOREIGN PATENT DOCUMENTS

| | | | |
|---|---|---|---|
| DE | 3815249 | A1 | 10/1989 |
| EP | 2048323 | A1 | 4/2009 |
| WO | 2006119536 | A1 | 11/2006 |
| WO | 2010051593 | A1 | 5/2010 |
| WO | 2010118246 | A1 | 10/2010 |

* cited by examiner

*Primary Examiner* — John Kreck
(74) *Attorney, Agent, or Firm* — Michael Best & Friedrich LLP

(57) ABSTRACT

An assembly for mounting a cutter bit on a driven mechanism, the assembly comprising a bit holder including a holding portion adapted to receive the bit and a mounting base rear portion. The bit holder holding portion is a forward portion, the forward portion being separate from but connected to the mounting base rear portion.

20 Claims, 5 Drawing Sheets

MINER CUTTING BIT HOLDING APPARATUS

BACKGROUND

This disclosure relates to apparatus for holding a cutting bit used to cut earth, rock, pavement and the like and, in particular, to an improved cutting bit holding apparatus.

In the mining field and in other fields in which a large volume of hard materials must be cut, it is typical to employ an apparatus which includes a vertically moveable horizontal axis cutting drum having cutting bits attached thereto. By virtue of the engagement of the cutting bits, which are mounted on the rotating cutting drum, with the surface to be cut, material is removed from such surface for further processing.

Due to the substantial forces generated during the cutting operations, the cutting bits must be securely mounted on the cutting drums, and must also be readily removable for replacement. In one prior art form of cutting bit holding apparatus, a cutting bit having an elongated cylindrical shank and a hard cutting tip at one end, and an abutment surface at the other end, is retained in a bit holder which is usually welded to the cutting drum. Such bit holder includes a body portion having a forward surface (as taken in the cutting direction) and a rearward surface. A shank receiving bore extends through the body and forms openings in the forward and rearward surfaces for passage of the shank of the cutting bit there through.

Illustrated in FIG. 1 is shown a conventional cutting bit holder 10 which is mounted on a cutting drum 14 which is rotatable in the direction shown by arrow 16. Specifically, bit holder 10 is mounted as by welding on a riser block 18 that is mounted, also as by welding to the cutting drum 14. However, it will be appreciated that the bit holder 10 may be mounted directly on the cutting drum 14.

More particularly, as shown in FIGS. 2 and 3, a conventional bit assembly 13 comprises a bit 12 having a bit tip 24, and a bit sleeve 25. The bit sleeve 25 includes a holding portion adapted to receive the bit 12, and a bore through the holding portion. The bit assembly 13 also includes an ignition control unit 30 including a spray outlet 34 having an internal bore (not shown). In other embodiments, sleeveless bit assemblies (not shown) can be used.

The bit assembly 13 also includes a bit holder 40 including a mounting base, and means for releasably securing the ignition control unit 30 to the rear portion in the form of a retainer or clip 42. The mounting base has a forward portion 44 and a mounting base rear portion 48.

The mounting base forward portion 44 has an upwardly open socket 52 adapted to receive the bit sleeve 25 so that the bit tip 24 extends in a forward direction, and an opening 56 to the interior end of the upwardly open socket to assist in removal of the bit sleeve 25. The mounting base rear portion 48 has an upper opening 60 that receives the ignition control unit 30, and an internal water passageway 64 in communication with the upper opening 60. The base rear portion 48 also has an external grove 68 in communication with a drum internal passageway 72 in the drum 11. As is known in the art, a fluid such as water within the drum 11 flows out of the drum passageway 72, through the drum external groove 68, and then through the internal water passageway 64 to the upper opening 60. From there, the water passes through the ignition control unit 30, where the water is then sprayed on the surface being mined.

SUMMARY

This disclosure provides an improved bit holder assembly for mounting a cutter bit on a driven mechanism, the assembly comprising a bit holder including a holding portion adapted to receive the bit and a mounting base rear portion. The bit holder holding portion is a forward portion, the forward portion being separate from but connected to the mounting base rear portion.

The bit holder is an improvement over conventional bit holders for it permits significantly easier welding of the rear portion to the drum, and positioning of the forward portion by welding forward portion to the rear portion. By being of a two piece construction, as opposed to one as in the prior art, the bit holder of this disclosure permits the rear base portion to be common among all bit holder assemblies on a drum, but allows for forward portions to be specially designed for each holder location on the drum, thus permitting the fine tuning of the bit pattern on the drum.

Figure 2:
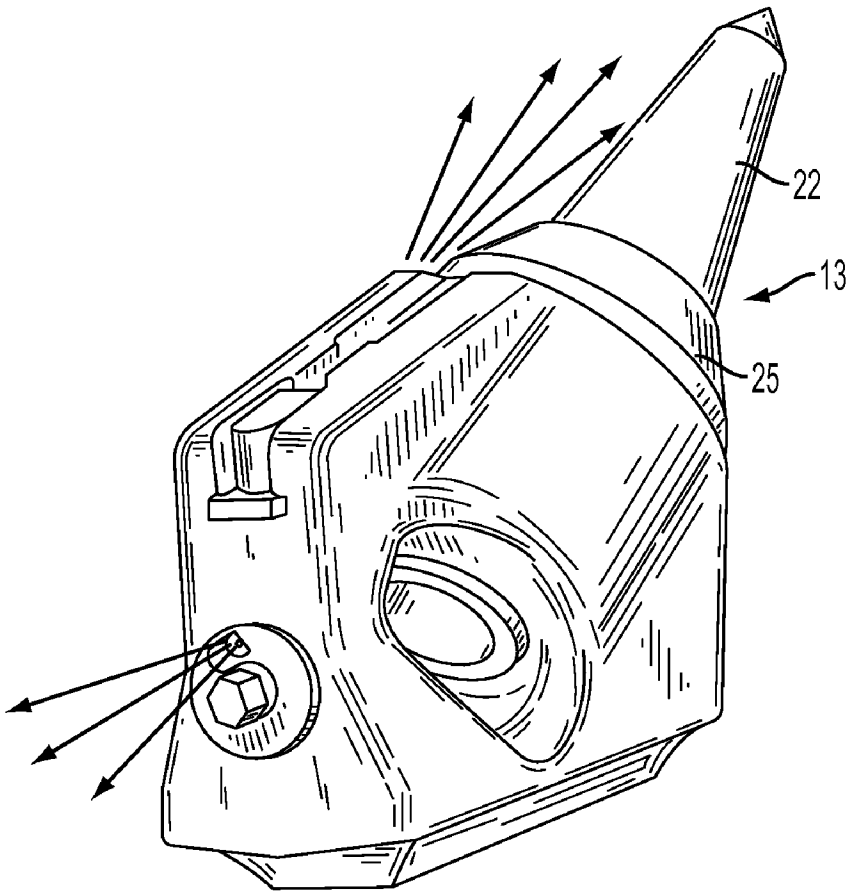
FIG. 2 PRIOR ART
FIG. 2 is a perspective view of a conventional bit holder.
Figure 1:
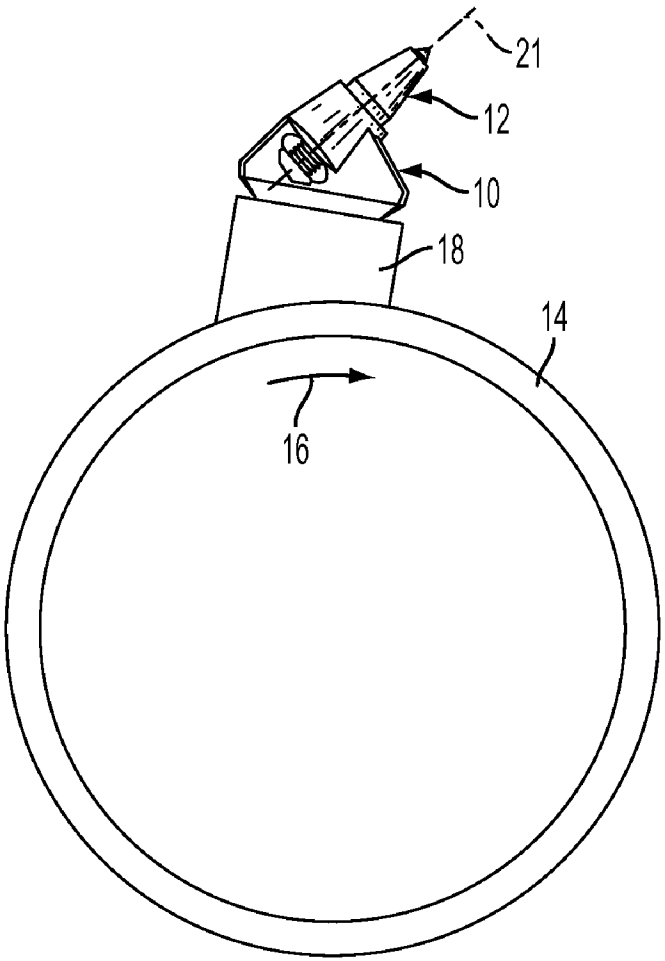
FIG. 1 PRIOR ART
FIG. 1 is a side elevation view of a conventional bit holder attached to a cutting drum.
Figure 3:
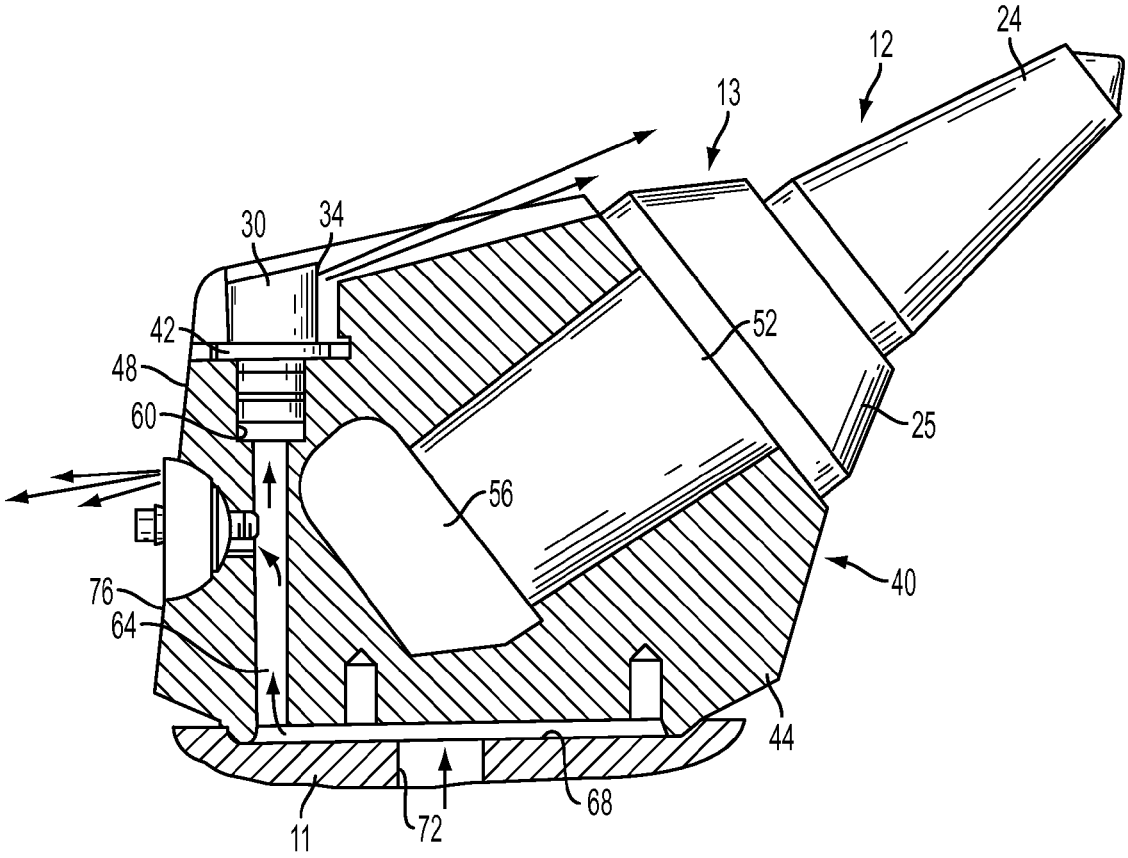
FIG. 3 PRIOR ART
FIG. 3 is a partial cut away view of the bit holder of FIG. 2.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT

Figure 4:
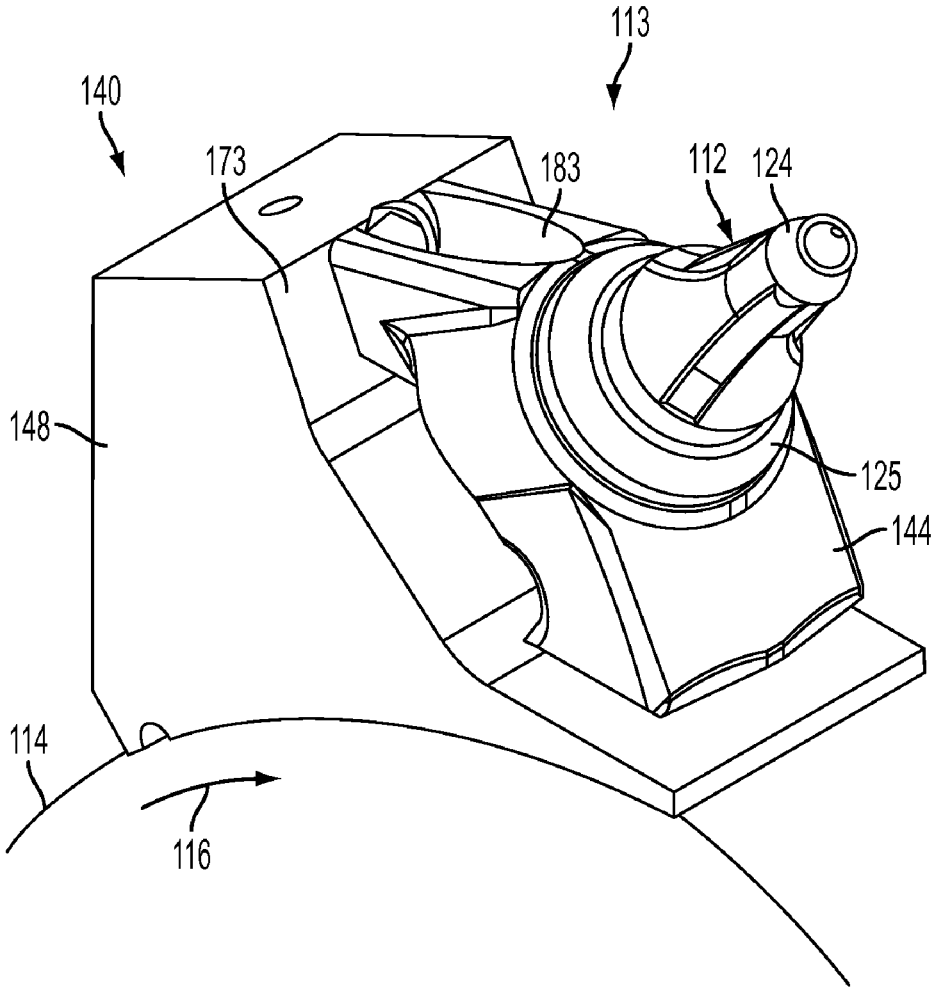
FIG. 4 is a perspective view of a bit holder according to this disclosure.
Figure 5:
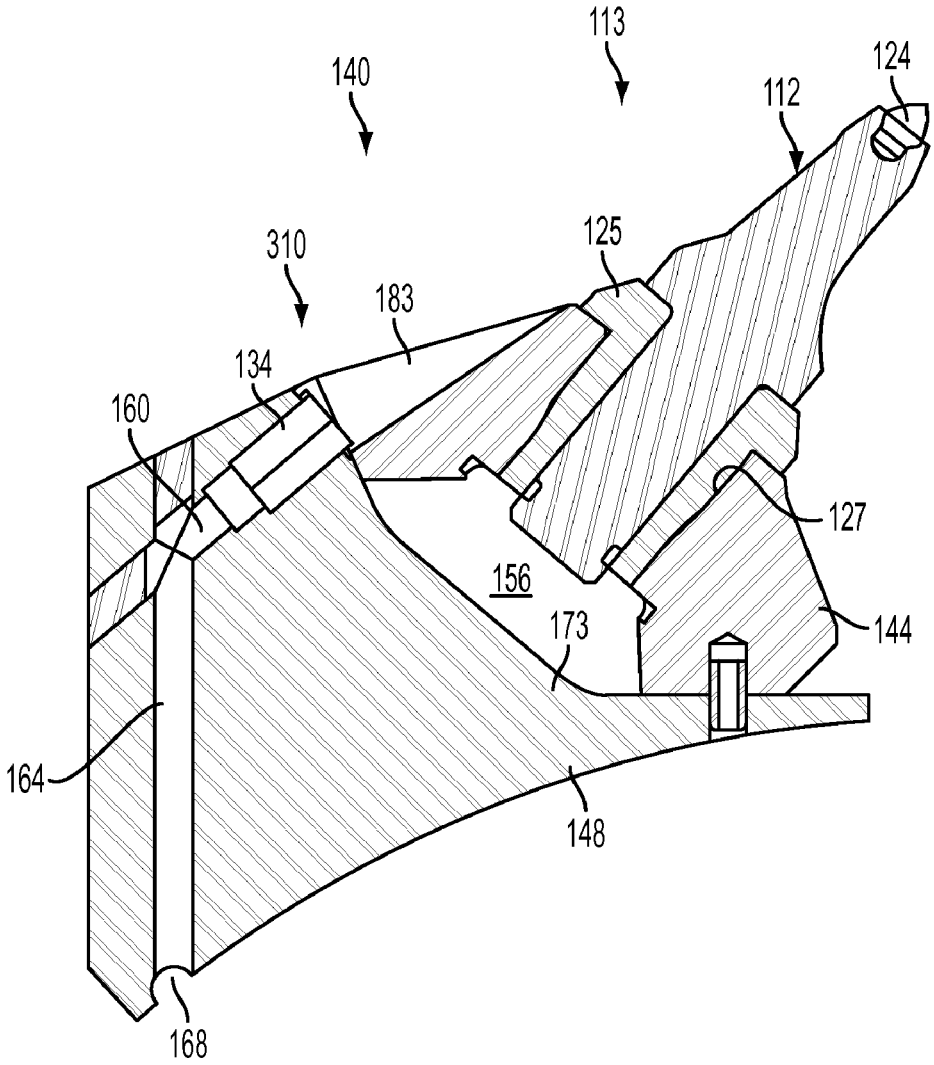
FIG. 5 is a cross sectional view of the bit holder shown in FIG. 4.

Illustrated in FIGS. 4 and 5 is an improved cutting bit holder 110 according to this disclosure that is mounted on a cutting drum 114 which is rotatable in the direction shown by arrow 116. Specifically, the bit holder 110 is mounted as by welding on the cutting drum 114.

More particularly, as shown in FIGS. 4 and 5, the bit assembly 110 comprises a bit 112 having a bit tip 124, and a bit sleeve 125. The bit sleeve 125 includes a holding portion adapted to receive the bit 112, and a bore 127 through the holding portion. The bit assembly 113 also includes an ignition control unit 310 including a spray outlet 134 having an internal bore (not shown). In other embodiments, sleeveless bit assemblies (not shown) can be used.

The bit assembly 113 also includes a bit holder 140 including a forward portion 144 and a mounting base rear portion 148.

The bit holder forward portion 144 has the upwardly open socket 127 adapted to receive the bit sleeve 125 so that the bit tip 124 extends in a forward direction, and an opening 156 to the interior end of the upwardly open socket to assist in removal of the bit sleeve 125. The mounting base rear portion 148 has an upper opening 160 that receives the ignition control unit 310, and an internal water passageway 164 in communication with the upper opening 160. The base rear portion 148 also has an external opening 168 in communication with a drum internal passageway (not shown) in the drum 114. As is known in the art, a fluid such as water within the drum 114 flows out of the drum passageway 172, through the drum external groove 168, and then through the internal water passageway 164 to the upper opening 160. From there, the water passes through the ignition control unit 310, where the water is then sprayed on the surface being mined.

More particularly, the rear portion 148 has a forward facing face 173. The forward portion 144 is separate from the rear portion 148, but is attached to the rear portion 148, such as by welding 190 (see FIG. 6). More particularly, the forward portion 144 is in the form of a bit receiving two-legged base. The forward portion 144 includes the opening 127 receiving the bit sleeve 125. The space 156 is between the base of the forward portion 144 and the rear portion face 173. This permits access to the bit 112 and bit holding sleeve 125, to assist in the removal of the bit 112 and the sleeve 125.

The forward portion 144 also includes a groove 183 permitting the spray from the spray outlet 134 to pass from the rear portion 148 through the forward portion 144. More particularly, the groove 183 is aligned with the spray outlet 134.

Figure 6:
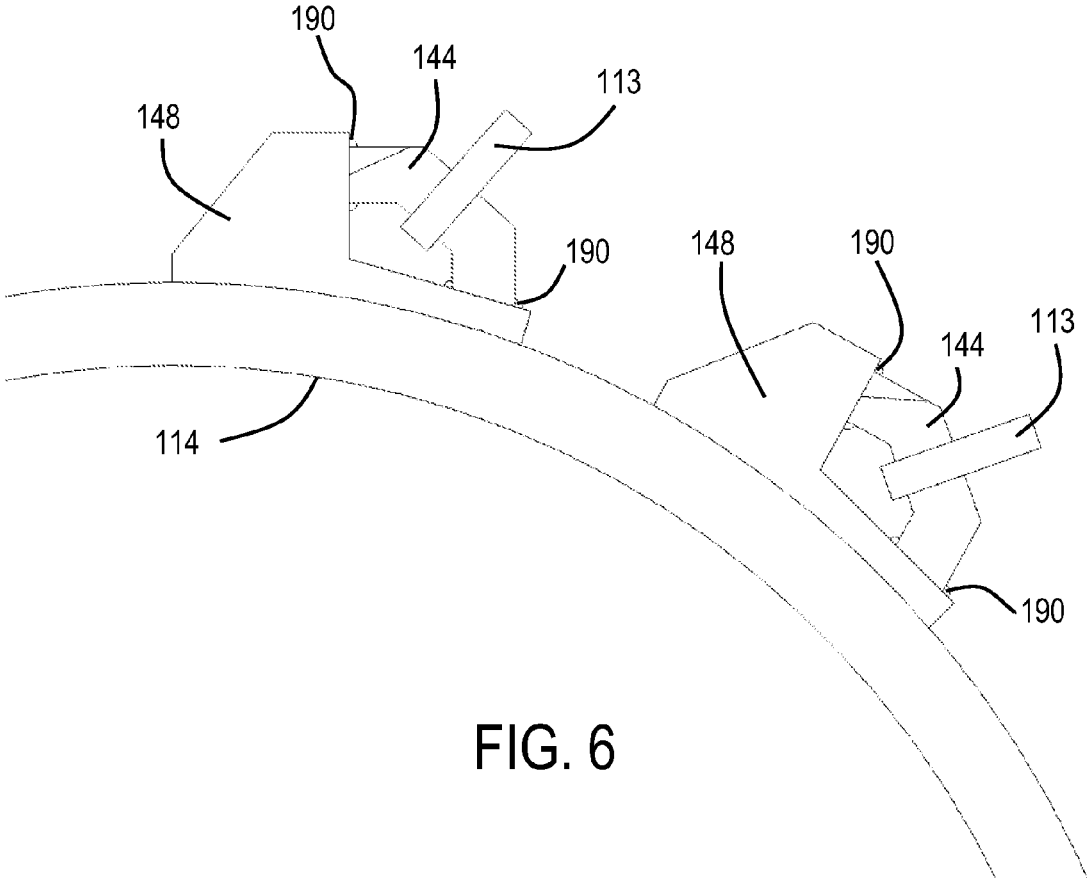
FIG. 6 is a side elevation view of bit holders according to the disclosure attached to a cutting drum.

FIG. 6 schematically illustrates bit holders 110 with rear base portions 148 common to the bit holders 110 on the drum 114 and forward portions 144 specially designed for each holder location on the drum 114. Each forward portion 144 is welded (at 190) to the associated rear base portions 148.

Various other features of this disclosure are set forth in the following claims.

The invention claimed is:

1. An assembly for mounting a cutter bit on a driven mechanism, said assembly comprising a bit holder including a holding portion adapted to receive the bit and a mounting base rear portion, said bit holder holding portion being a forward portion, said forward portion being separate from but connected to said mounting base rear portion, wherein said mounting base rear portion has a forward facing face, and wherein said forward portion has a bit receiving base with an opening therethrough which receives the bit and two legs maintaining the bit receiving base in spaced relation from the mounting base portion forward face and permitting access to the bit between the mounting base rear portion forward face and the forward portion, wherein said mounting base rear portion has an internal water passageway with a spray outlet wherein said forward portion has a groove in a surface of one leg and aligned with said spray outlet.

2. An assembly in accordance with claim 1, further comprising an ignition control unit.

3. An assembly in accordance with claim 1, wherein the two legs form an opening therebetween, each leg being connected to the mounting base rear portion.

4. An assembly in accordance with claim 3, wherein the opening provides access to the bit.

5. An assembly in accordance with claim 1, wherein the one leg at least partially surrounds the spray outlet.

6. A cutting bit holder for attachment to a cutting drum of a mining machine, the cutting drum extending along an axis and having a circumference, the bit holder supporting a cutting bit, the bit holder comprising:

a rear portion mounted to the cutting drum; and a separate forward portion attached to the rear portion, the forward portion defining a bore for supporting the cutting bit, wherein the rear portion defines a forward facing surface, wherein the forward portion includes a base defining the bore and two legs spaced apart from one another, each leg having an end attached to the rear portion and spaced about the circumference of the cutting drum, the legs maintaining the base in spaced relation from the rear portion, and wherein the rear portion and the forward portion define an opening between the forward facing surface and the two legs, the opening extending parallel to the axis and being open on each axial side of the legs to provide access to the cutting bit.

7. The bit holder of claim 6, wherein the bore receives a bit holder including a holding portion adapted to receive the cutting bit.

8. The bit holder of claim 6, further comprising an ignition control unit.

9. The bit holder of claim 8, wherein the ignition control unit is at least partially defined by an internal water passageway and a spray outlet formed in the rear portion and a groove formed in the forward portion, the groove being aligned with the spray outlet to permit a spray stream from the spray outlet to pass from the rear portion through the forward portion.

10. The bit holder of claim 6, wherein the forward portion is welded to the rear portion.

11. The bit holder of claim 6, wherein the rear portion and the forward portion are formed separately.

12. The bit holder of claim 9, wherein the groove is formed in a surface of one leg.

13. The bit holder of claim 12, wherein the one leg at least partially surrounds the spray outlet.

14. A cutting drum for a mining machine, the cutting drum comprising:

a substantially cylindrical drum;

a first bit holder rear portion welded to the cylindrical drum at a first location;

a second bit holder rear portion welded to the cylindrical drum at a second location, the first bit holder rear portion and the second bit holder rear portion being substantially the same, the first location and the second location being different;

a separate first bit holder forward portion attached to the first bit holder rear portion, the first bit holder forward portion defining a bore for supporting a first cutting bit; and a separate second bit holder forward portion attached to the second bit holder rear portion, the second bit holder forward portion defining a bore for supporting a second cutting bit, the second bit holder having a design different than the first bit holder.

15. The cutting drum of claim 14, wherein the first bit holder rear portion and the second bit holder rear portion have substantially the same orientation with respect to the cylindrical drum.

16. The cutting drum of claim 14, wherein the first bit holder forward portion and the second bit holder forward portion each define two legs spaced apart from one another, each leg being attached to the corresponding bit holder rear portion.

17. The cutting drum of claim 16, wherein the first bit holder rear portion and the second bit holder rear portion each define a forward facing surface, and wherein an opening is defined between the two legs of each bit holder forward portion and the forward facing surface of each bit holder rear portion, each cutting bit being accessible via the corresponding opening.

18. The cutting drum of claim 14, further comprising an ignition control unit associated with each bit holder rear portion.

19. The cutting drum of claim 18, wherein each ignition control unit provides a spray of liquid, and wherein each bit holder forward portion is arranged to permit the spray of liquid to pass through the corresponding bit holder forward portion.

20. The cutting drum of claim 16, wherein each mounting base rear portion has an internal water passageway with a spray outlet, and wherein each forward portion has a groove defined in one leg and aligned with the spray outlet of the corresponding mounting base rear portion.

* * * * *